US005220738A

United States Patent [19]

Baldacci

[11] Patent Number: 5,220,738

[45] Date of Patent: Jun. 22, 1993

[54] LATCHED TWO PART STEAM IRON WITH SAFE ELECTRICAL ASSEMBLY/DISASSEMBLY

[76] Inventor: Lapo Baldacci, Via Cernaia 86 I, 50129 Firenze, Italy

[21] Appl. No.: 708,987

[22] Filed: May 31, 1991

[51] Int. Cl.[5] ..... D06F 75/18; D06F 75/28; D06F 75/38

[52] U.S. Cl. ..... 38/81; 38/88; 219/256

[58] Field of Search ..... 38/74, 77.8, 81, 88, 38/97, 77.3, 77.5, 77.9, 89, 91; 219/245, 247, 256, 246, 250, 254; 392/404

[56] References Cited

U.S. PATENT DOCUMENTS

| | | | |
|---|---|---|---|
| 869,679 | 10/1907 | Adams | 38/97 |
| 962,768 | 6/1910 | Levy | 219/256 X |
| 1,029,233 | 6/1912 | Schild | 38/81 |
| 1,421,586 | 7/1922 | Shirk et al. | 219/247 |
| 1,583,460 | 5/1926 | Hansson | 38/81 |
| 1,665,768 | 4/1928 | Browning | 38/97 X |
| 1,736,148 | 11/1929 | Brewer | 38/77.7 |
| 2,163,704 | 6/1939 | Ritz-Woller | 219/256 X |
| 2,302,264 | 11/1942 | Schwartz | 38/97 X |
| 2,387,757 | 10/1945 | Hoecker | 38/77.5 |
| 2,408,209 | 9/1946 | Gould | 38/81 X |
| 2,500,091 | 3/1950 | Parr | 38/88 |
| 2,607,138 | 8/1952 | Russell | 38/74 X |
| 2,612,587 | 9/1952 | Guerra | 38/81 |
| 3,071,879 | 1/1963 | Blank | 38/97 X |
| 3,175,316 | 3/1965 | Foster et al. | 38/81 X |
| 3,413,741 | 12/1968 | Schwartz et al. | 38/77.3 |
| 3,906,187 | 9/1975 | Turoczi | 38/81 X |
| 4,532,411 | 7/1985 | Terraillon et al. | 38/81 X |
| 4,948,945 | 8/1990 | Wu | 219/247 |

FOREIGN PATENT DOCUMENTS

| | | | |
|---|---|---|---|
| 0074498 | 12/1960 | France | 38/97 |
| 2148700 | 7/1987 | Japan | 38/81 |
| 2221925 | 2/1990 | United Kingdom | 219/247 |

*Primary Examiner*—Clifford D. Crowder
*Assistant Examiner*—Ismael Izaguirre
*Attorney, Agent, or Firm*—McGlew & Tuttle

[57] ABSTRACT

A steam iron, particularly of the so called "drop-by-drop" type, where in order to cause an instantaneous steam production, the water which is contained in a reservoir (11) incorporated in the iron falls drop-by-drop into a vaporization chamber (2) provided in the inner side of the sole plate (1) of the iron in registry with the heating resistance of the sole plate (1), the so-generated steam being conveyed outwards through holes (7) in the sole plate (1). The iron is constituted by two parts (1,10) which are releasably fastened to each other by a latching device. One of the parts forms the body (10) of the iron, with the handle (110), the water reservoir (11), a portion of the latch, and the portion of the electrical connector with the diverting lug, while the other part forms the sole plate (1) of the iron with the electrical resistance, vaporization chamber (2), another portion of the latch, and the other portion of the electrical connector with the gate. The Lug and gate coact upon assembly or disassembly to protect the user from electrical shock.

9 Claims, 3 Drawing Sheets

LATCHED TWO PART STEAM IRON WITH SAFE ELECTRICAL ASSEMBLY/DISASSEMBLY

FIELD OF THE INVENTION

The invention relates to a steam iron, particularly of the so-called "drop by drop type", wherein in order to cause an instantaneous steam production, the water which is contained in a reservoir incorporated in the iron falls drop-by-drop into a vaporization chamber provided in the inner side of the sole plate of the iron, in registry with the heating resistance of said sole plate, the so-generated steam being conveyed outwards through a plurality of holes in the sole plate.

BACKGROUND OF THE INVENTION

As a result of the conversion of water into steam, saline scales, more particularly calcareous scales, will be formed in the vaporization chamber, which has usually a labyrinth configuration. In the course of time, said scales can reach such dimensions as to fill substantially or even completely the vaporization chamber, thus compromising the proper operation of the iron and, possibly, damaging it irretrievably. With the conventional irons of the type specified above, it is extremely difficult or even impossible to reach the vaporization chamber either to eliminate said scales mechanically or even to replace it.

From U.S. Pat. No. 724,198 a steam iron is known according to which the handle, cover, shell and water reservoir of the iron may be disassembled from the sole plate, thus exposing the cover sole plate of the steam generating chamber.

The above disassembling operation, although comparatively simple to be performed, still requires a certain skill, since (see column 4, lines 17 to 31 of the cited document) it requires the removal of the thermostat dial and the unscrewing of an assembly bolt, that is a number of operations requiring the use of tools, and a certain skill in disassembling and re-assembling of said parts which are not within the reach of a person having no elementary technical skill, like an average homemaker.

From U.S. Pat. No. 3,413,741 a steam iron is known formed by a number of component parts (at least three) which are connected together by means of manually operable latching means so that the parts can be assembled and disassembled without the use of tools.

The main drawback of the above described prior art steam iron resides in the fact that it may easily happen that the parts becomes unadvertently unlatched, or connected by a bad latch, in which case there is the danger of electric shocks to the user, or of bad contacts between the electric terminals, with consequent sparking and overheating of the terminals.

SUMMARY AND OBJECTS FOR THE INVENTION

The invention aims to provide a steam iron which obviates to the drawback of the above mentioned prior art steam irons.

It is therefore the main object of the present invention to provide a steam iron of the type mentioned above, in which the sole plate comprises a portion of a plug-and-socket connector while, arranged in the body of the cover shell, there is the other complementary portion of the plug-and-socket connector, which is connected to the electricity supply cord, said two portions being arranged so as to penetrate each other upon assembling the sole plate with the said body, means being arranged in said the body of the iron for enclosing the portion of the plug-and-socket connector provided in said body in the disassembled condition of the sole plate sole plate from the body, said means being opened automatically by the portion of the plug-and-socket connector associated to the sole plate upon assembling it on the said body.

According to a further feature of the invention, said enclosing means for the plug-and-socket connector portion associated to said body comprises a gate which is mounted so as to be slidable in both directions on the plug-and-socket connector portion and is urged resiliently to its closed position by springs and is provided at each side with ribs co-operating with diverging lugs provided with a sloping upper edge and protruding vertically upwards beyond the plug-and-socket connector portion which is associated with the sole plate at each of its sides.

The invention also relates to other characteristics which further improve said iron and which form the subject of further features of the invention.

BRIEF DESCRIPTION OF THE DRAWINGS

The particular features of the invention and the advantages resulting therefrom will be apparent with more details from the description of a preferred embodiment thereof which is shown as a non-limiting example in the accompanying drawings, wherein.

DETAILED DESCRIPTION OF THE PREFERRED EMBODIMENTS

Figure 1:
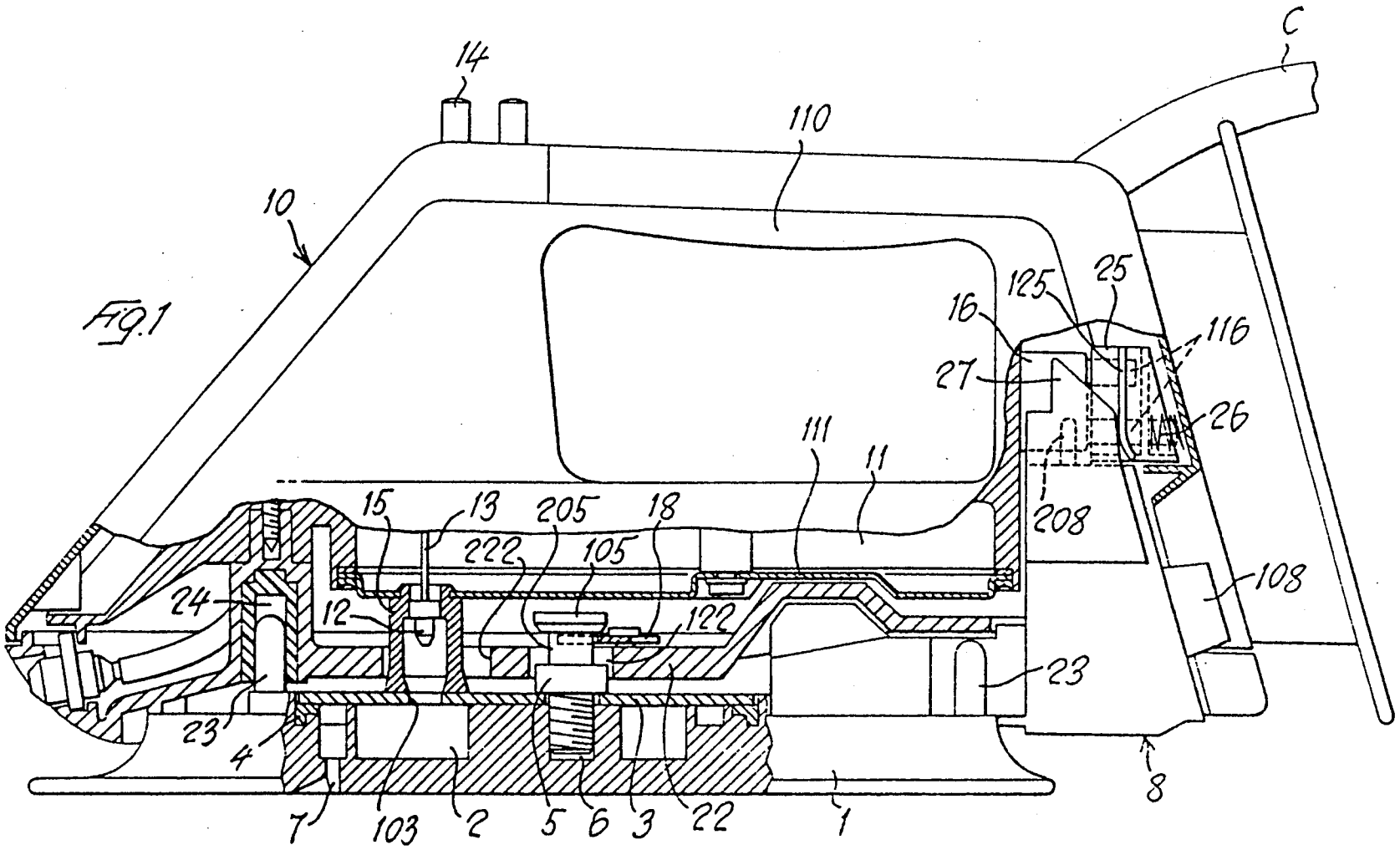
FIG. 1 is an elevational and partly sectional side view of the smoothing iron according to the invention.

As from the Figures, the iron according to the invention comprises a sole plate indicated generally at 1. Incorporated, preferably embedded, in the sole plate 1, in registry with a vaporization chamber of the labyrinth type 2, is a heating resistance (not shown) for the sole plate 1. The vaporization chamber 2 can be opened at its top side. It is provided with a cover 3 which is secured through the intermediary of a seal 4 by means of a bolt 5 which can be screwed into an associated threaded hole 6 in the sole plate 1. The lower face of the sole plate 1 exhibits a plurality of holes 7 communicating with the interior of the vaporization chamber 2. The holes 7 are flaring out at their outlet in the lower side of the sole plate 1. The sole plate 1 is provided, in the rear region thereof, with a regulation and control unit for the heating resistance, which is indicated generally at 8. Said unit 8 is provided at its rear side, extending beyond the end of said sole plate 1, with a control knob 108 for the thermostat, and a portion 208, preferably the male portion, of a plug-and-socket connector for connection to an electricity supply cord C. The portion 208 of the plug-and-socket connector has vertical upwardly-directed prongs.

The body of the iron, indicated generally at 10, is constructed as a part separate from the sole plate 1 of the iron and can be releasably fastened thereto.

The body 10 is provided with a handle 110 and comprises at the lower side thereof, which is facing the sole plate 1, a water reservoir 11. The water reservoir 11 comprises at the bottom thereof a nozzle 12 for drop-dispensing which may be either opened and closed by a plug 13. The plug 13 is connected operatively to a control pushbutton 14 provided on the top side of the body 10. The drop-dispensing nozzle 12 is in registry with a feed opening 103 in the cover 3 for the vaporization chamber 2. When the sole plate 1 and body 10 are in the assembled condition, the nozzle 12 is sealingly connected to the feed opening 103 by means of a cup-shaped seal-member 15 the free edges of which are compressed around said opening 103 against the cover 3. The body 10 of the iron comprises at the rear thereof, in a mating, vertically-aligned position with respect to the portion 208 of the plug-and-socket connector secured to the sole plate 1, the other portion 16 of the plug-and-socket connector having connected thereto the electrical feeding cord C. The rear side of the body 10 of the iron is provided with a recess 17 having a configuration corresponding to the back of the control and regulation unit 8 for the thermostat. The recess 17 is opened at the rear side thereof whereby, when assembled, a control knob 108 protrudes from said rear side outwards.

Figure 2:
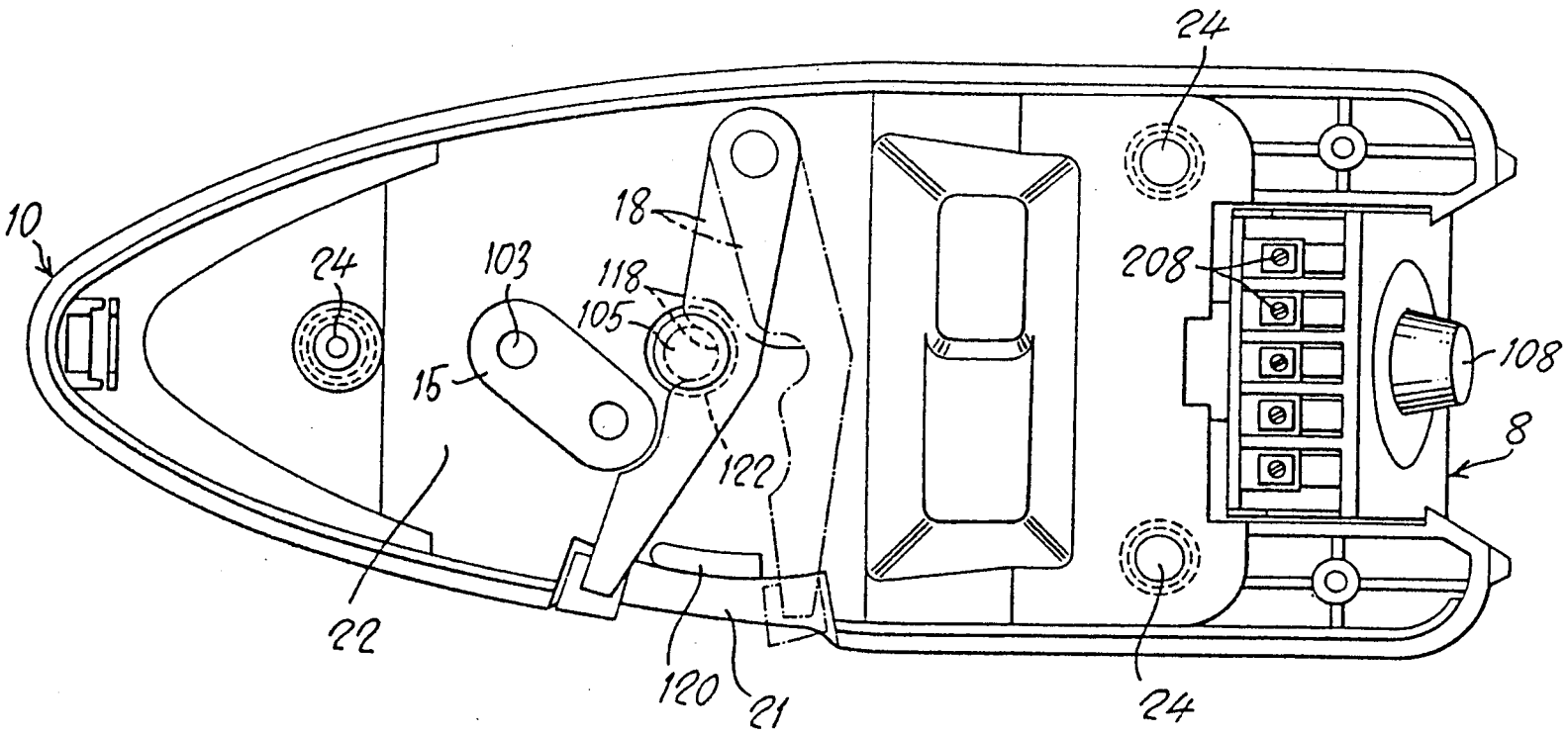
FIG. 2 is a sectional view of the iron according to FIG. 1 along a horizontal plane at the means for fastening together the two parts of the iron.

The means for fastening the sole plate 1 to the body 10 of the smoothing iron may be of any construction. More particularly, said means comprises an axial top extension 105 of said bolt 5 which secures the cover 3 on the vaporization chamber 2. Said extension 105 comprises a peripheral annular groove 205 the upper side of which is beveled i.e. flaring conically. The body 10 of the iron comprises a coupling member which, in its simplest embodiment, comprises a small lever 18 pivotably mounted parallelly to the plane of the sole plate 1. The free end portion of the pivotable lever 18 extends through a lateral slit 20 in the iron, preferably into the interior of an elongated recess 21 so that it can be grasped and pivoted easily though not protruding beyond the outer surface of the body 10 of the iron. Said pivotable lever 18 is formed with a coupling slot 118 whereby, as best shown in FIG. 2, it interengages in the peripheral groove 205 of the fastening extension 105 of the bolt 5.

According to a further advantageous characteristic of the invention, the small lever 18 is arranged in a space between the bottom of the water reservoir 11 and the lower wall 22 of the body 10 of the iron. The lower wall 22 comprises a hole 122 in registry with the bolt 5, i.e. with the fastening extension 105. In the assembled condition of the sole plate 1 with the body 10, said extension 105 protrudes upwards from the wall 22 through the hole 122. Upon interengaging the lever 18 and the extension 105, thanks to a suitable selection of the dimensions of said co-operating members, it is possible to achieve not only a mere fastening of the sole plate 1 to the body 10, but also a certain tightening action due to the bevel of the upper side of the annular groove 205. Moreover, the lower wall 22 comprises an additional opening 222 wherethrough the cup-shaped seal member 15 and associated drop-dispensing nozzle 12 is passed. The coupling lever 18 may have associated therewith means 120 for locking its coupling position. Said means 120 may have any suitable construction. For example, said means may comprise suitably-shaped abutment detents or projections in the lateral slit 20. Said abutment detents may be so arranged as to permit the movement of said lever back to the disengaged position only by elastically flexing said lever upwards so that it can travel thereover.

In order to ensure an optimum centering of the sole plate 1 with respect to the body 10 of the iron, upon assembling them, and to further facilitate said assembling step, the sole plate 1 is provided with corresponding centering posts 23 which interengage with corresponding recesses 24 in the body 10. Said recesses may be made—or possibly only coated inside—with resilient material such as rubber, which also ensures a spring-like effect on the sole plate and a tightening effect of the centering posts 23 in the associated recesses 24. The sole plate 1 is thus held in its assembled position even when the lever 18 is disengaged inadvertently from the fastening extension 5.

Figure 3:
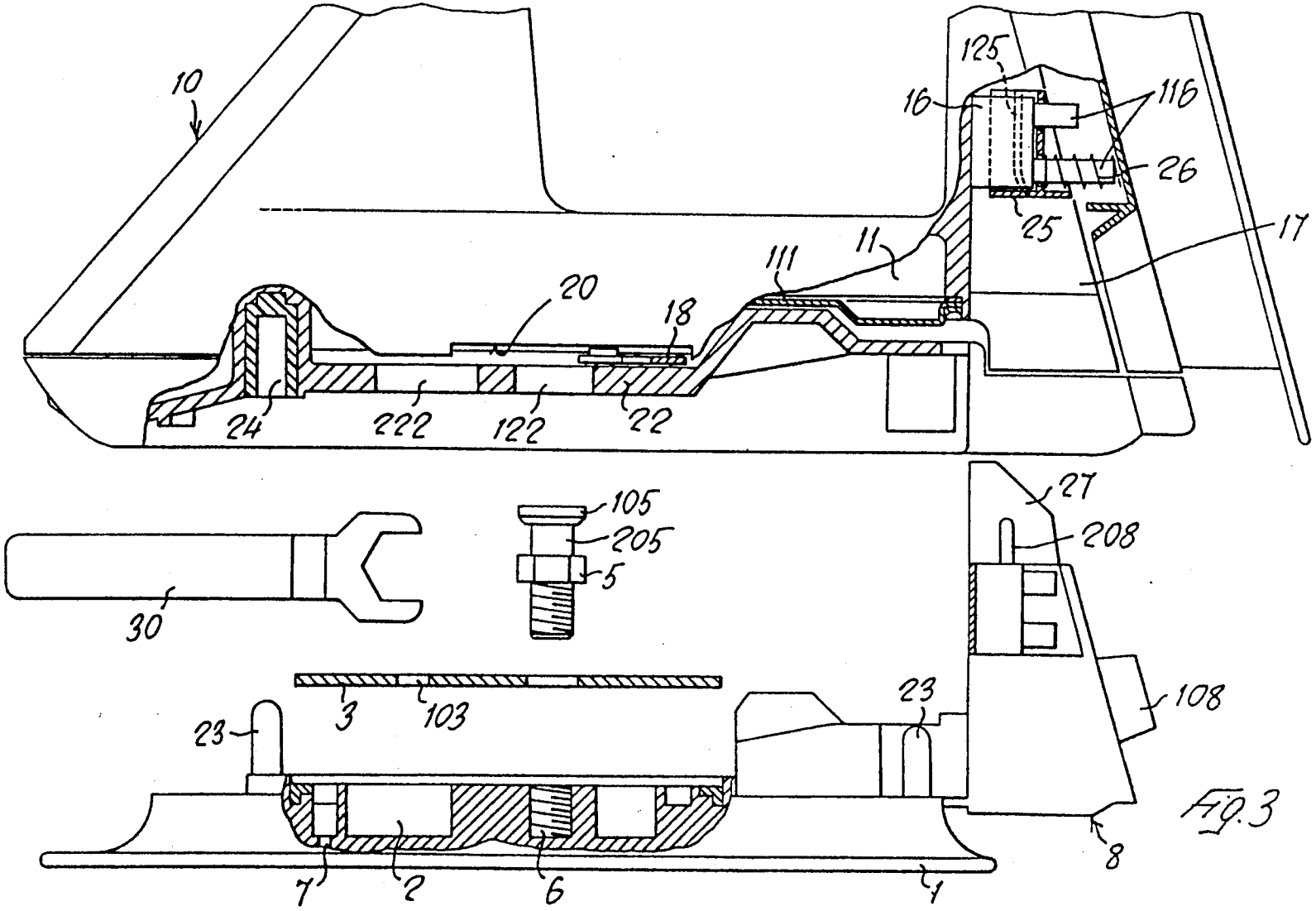
FIG. 3 is a side view of the iron, in its disassembled condition for the removal of scales.

According to a further advantageous characteristic of the invention and as shown more particularly from FIGS. 1 and 3, the female portion 16 of the plug-and-socket connector, which is connected with the body 10, is sealed from the exterior by means of a gate 25 which is urged to its closed position by springs 26. More particularly, the gate 25 is mounted so as to be slidable in both directions longitudinally of the iron on horizontal guide pins 116 protruding from the rear end side of the portion 16 of the connector. Between the rear end side of the gate 25 and the associated rear wall of the body 10 of the iron—on each guide pin 16 or only on some of them—there is provided a coil spring 26 which is loaded in the closing direction of the connector portion 16. The opening of said gate 25 is effected automatically upon assembling the sole plate 1 on the body 10. For this purpose, on both sides of the connector portion 208 which is connected with the sole plate 1 there is provided a diverting lug 27 protruding upwards beyond the prongs of the connector portion 208 and the upper side of which is substantially sloping downwards towards the rear end side of the iron. The sloping upper side of each diverting lug 27 co-operates with a suitably shaped lateral rib 125 of the respective side of the connector portion 16 associated with the body 10 of the iron. The above in view of a progressive opening motion of the gate 25, said gate being moved rearwards by the diverting lugs 27, upon approaching the two portions 16 and 208 of the plug-and-socket connector towards each other. Obviously, upon moving the two connector portions 16, 208 away from each other, the gate 25 will move back over the connector portion 16 to prevent direct access thereto from the lower side of the body 10. This provision ensures the utmost safety for the user of the iron against any inadvertent contact with the electrical conductors connected to the electrical mains, thus rendering the iron safer.

As appearing also graphically from FIG. 3, to reach the vaporization chamber 2 for removal of scales therefrom, it is sufficiente to disassemble the sole plate 1 from the remaining body 10 of the iron by merely acting on the fastening lever 18. The two parts may be separated by a soft tractive effort it disengage the centering posts 23 from the recesses 24. Simultaneously, thanks to the plug-and-socket connector, the electrical contact between the sole plate 1 and electrical supply cord C is broken. Thereafter, with the aid of a suitable tool, shown as a wrench 30 in the Figure, the cover 3 may be disassembled from the vaporization chamber 2 and the interior of the latter may be reached. On completion of the cleaning operations, the iron may be merely reassembled by the reverse operations.

While a specific embodiment of the invention has been shown and described in detail to illustrate the application of the principles of the invention, it will be understood that the invention may be embodied otherwise without departing from such principles.

I claim:

1. A steam iron, wherein to cause an instantaneous steam production, water contained in a reservoir (1) comprised in the iron falls drop-by-drop into a vaporization chamber (2) provided in an inner portion of a sole plate (1) which is in registry with a heating resistance comprised by said sole plate (1), the generated steam is conveyed outwards through a plurality of holes (7) in the sole plate (1), the iron comprises two parts (1,10) which are releasably fastened to each other by manually operable latching means, one part substantially comprises the body (10) of the iron, with a handle (110) and said water reservoir (11), and the other part comprises the sole plate (1) of the iron, with the heating resistance and said vaporization chamber (2), and wherein the sole plate (1) comprises a first portion (208) of a plug-and-socket connector, and the body (10) comprises a second portion (16) of the plug-and socket connector, which is connected to an electricity supply cord (c) said first and second portions are penetrable into each other automatically upon assembly of the sole plate (1) with the body (10) and the body 10 of the iron further has means (25) for enclosing said second portion (16) of the plug-and socket connector such that said plug-and-socket connector is in an enclosed state when the iron is in a disassembled condition, said means (25) is moved automatically by said first portion (208) of the plug-and-socket connector of the sole plate (1) such that said plug-and-socket connector is not in said enclosed state upon assembly of said sole plate to the body (10).

2. The iron according to claim 1, wherein said latching means comprises a coupling pin (105) removably secured to the sole plate (1) and a coupling lever (18) pivotably mounted parallel to the sole plate (1) in the body (10) of the iron, said coupling pin (105) comprises an annular peripheral groove (205) having an upper beveled side, and said coupling lever (18) is provided with a co-operating hook-like recess (118).

3. The iron according to claim 2, wherein said coupling lever (18) swivels in a space between the bottom of the reservoir (11) and a bottom wall of the body (10) of the iron, said wall being provided with a hole (122) for insertion of said coupling pin (105), while a free end of the lever (18) extends through a lateral slit (20) into an elongated recess (21) of the body (10) and up to an outline of the body (10).

4. The iron according to claim 2 or 3, further comprising means for locking said lever (18) in a position wherein said means fastens the sole plate (1) to the body of the iron.

5. The iron according to claim 2, wherein the vaporization chamber (2) has a cover (3) which is sealed to said chamber by a gasket (4) and a bolt (5).

6. The iron according to claim 5, wherein the coupling pin (105) co-operating with the lever (18) comprises an axial extension below a top portion thereof (5) for removably securing the cover (3).

7. The iron according to claim 1, wherein the sole plate (1) comprises centering posts (23) at corner regions, co-operating with recesses (24) in the body (10) comprising resilient material.

8. The iron according to claim 1, wherein said enclosing means (25) for the plug-and-socket connector portion (16) comprises a gate slidably mounted so as to move in two directions on the plug-and-socket connector second portion (16) and is urged resiliently to a closed position by springs (26) and provided at each side with ribs (116) co-operating with diverting lugs (27) having a sloping upper edge and protruding vertically upwards beyond the plug-and-socket connector first portion (208) comprised by the sole plate (1) at each first portion respective sides.

9. The iron according to claim 1, wherein the sole plate (1) has means (8) for controlling and regulating the heating resistance, said means being provided at a rear end side of said sole plate with a control knob (108) and thereabove with said plug-and-socket connector first portion (208), while a rear end side of the body (10) is formed with a recess (17) which is opened rearwards whereby in the assembled condition of the iron (1) said control knob (108) is accessible from the rear end side of the body (10).

* * * * *